US011889898B2

(12) United States Patent
Takamasu et al.

(10) Patent No.: US 11,889,898 B2
(45) Date of Patent: Feb. 6, 2024

(54) SHOE INCLUDING CORRECTION MEMBER ATTACHED TO UPPER

(71) Applicant: ASICS CORPORATION, Hyogo (JP)

(72) Inventors: Sho Takamasu, Hyogo (JP); Kana Arimoto, Hyogo (JP); Satoru Abe, Tokyo (JP); Azumi Taoka, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 58 days.

(21) Appl. No.: 17/555,512

(22) Filed: Dec. 20, 2021

(65) Prior Publication Data

US 2022/0192321 A1 Jun. 23, 2022

(30) Foreign Application Priority Data

Dec. 23, 2020 (JP) ..... 2020-214318

(51) Int. Cl.
*A43B 23/08* (2006.01)
*A43B 23/28* (2006.01)

(52) U.S. Cl.
CPC ..... *A43B 23/28* (2013.01); *A43B 23/088* (2013.01)

(58) Field of Classification Search
CPC ..... A43B 23/22; A43B 23/227; A43B 23/088; A43B 7/24; A43B 7/14; A43B 21/32; A43B 5/1691; A43C 11/004
See application file for complete search history.

(56) References Cited

U.S. PATENT DOCUMENTS

| | | | | |
|---|---|---|---|---|
| 4,451,996 | A * | 6/1984 | Norton | A43B 19/00 36/129 |
| 4,856,209 | A * | 8/1989 | Kenyon | A43B 7/20 36/114 |
| 5,755,044 | A | 5/1998 | Veylupek | |
| 5,946,825 | A * | 9/1999 | Koh | A43B 23/028 36/55 |
| 6,298,582 | B1 * | 10/2001 | Friton | A43B 23/027 36/102 |
| 10,182,620 | B2 * | 1/2019 | Schenone | A43B 23/025 |
| 2004/0111923 | A1 * | 6/2004 | Brooks | A43B 7/14 36/89 |
| 2006/0145434 | A1 * | 7/2006 | Crowder | A63C 1/20 280/11.12 |

(Continued)

FOREIGN PATENT DOCUMENTS

EP 2974615 1/2016

OTHER PUBLICATIONS

"Search Report of Europe Counterpart Application", dated May 9, 2022, p. 1-p. 7.

*Primary Examiner* — Jillian K Pierorazio
(74) *Attorney, Agent, or Firm* — JCIPRNET

(57) ABSTRACT

A shoe includes a sole provided with a ground contact surface, an upper provided with an opening into which a foot of a wearer is inserted, the upper being attached to the sole and covering the foot of the wearer, and a correction member including an inner arm fixed to a medial foot side of the opening of the upper, an outer arm fixed to a lateral foot side of the opening of the upper, and a connection portion connecting the inner arm and the outer arm, the correction member being attached to the upper away from the sole in such a manner that the connection portion is disposed on a rear side of the opening.

4 Claims, 8 Drawing Sheets

(56) References Cited

U.S. PATENT DOCUMENTS

| | | | | |
|---|---|---|---|---|
| 2014/0259781 | A1* | 9/2014 | Sakai | A43B 1/0081 36/102 |
| 2016/0007687 | A1* | 1/2016 | Surace | A43B 7/088 36/89 |
| 2016/0095383 | A1* | 4/2016 | Surace | A43B 23/28 36/93 |
| 2020/0068996 | A1* | 3/2020 | Halahmi | A43C 11/24 |
| 2020/0163790 | A1* | 5/2020 | Ostergard | A61F 5/0111 |
| 2020/0359745 | A1* | 11/2020 | Tresser | A43B 7/24 |

* cited by examiner

SHOE INCLUDING CORRECTION MEMBER ATTACHED TO UPPER

CROSS-REFERENCE TO RELATED APPLICATIONS

The present application claims priority to and incorporates by reference the entire contents of Japanese Patent Application No. 2020-214318 filed in Japan on Dec. 23, 2020.

BACKGROUND OF THE INVENTION

1. Field of the Invention

The invention relates to a shoe.

2. Description of the Related Art

Since the opening of a shoe is for putting a foot of a wearer in and out, it is preferable that the opening is wide when the shoe is put on or taken off. Meanwhile, in order to prevent the foot from being displaced inside the shoe and getting a shoe sore or to prevent the fitting property to the foot of the wearer from being lowered, it is preferable that the opening of the shoe is narrow while the shoe is worn.

For this reason, many shoes are provided with tightening members, such as shoelaces or hook-and-loop fasteners, in a portion in front of the opening to prevent the opening from widening while being worn by using the tightening members while being worn and to enhance the fitting property to a foot of a wearer. For a shoe provided with a tightening member, the opening can be widened by loosening the tightening member, and the ease of being put on and taken off is not impaired even if the fitting property to a foot of a wearer is enhanced.

In recent years, further enhancement in the fitting property of shoe has been required. U.S. Pat. No. 5,755,044 discloses a shoe in which the ends of a shoelace are fixed to the rear side of the shoe in order to narrow the opening while the shoe is worn.

However, since a tightening force in the front-rear direction is applied to the opening in the shoe disclosed in U.S. Pat. No. 5,755,044, this easily generates a gap between the opening and the foot of the wearer in the foot width direction when the foot of the wearer plantarflexes. If a gap is generated between the opening and the foot of the wearer, the foot is easily displaced inside the shoe.

SUMMARY OF THE INVENTION

A shoe according to an aspect of the invention includes a sole provided with a ground contact surface, an upper provided with an opening into which a foot of a wearer is inserted, the upper being attached to the sole and covering the foot of the wearer, and a correction member including an inner arm fixed to a medial foot side of the opening of the upper, an outer arm fixed to a lateral foot side of the opening of the upper, and a connection portion connecting the inner arm and the outer arm, the correction member being attached to the upper away from the sole in such a manner that the connection portion is disposed on a rear side of the opening.

DETAILED DESCRIPTION OF THE EXEMPLARY EMBODIMENTS

Hereinafter, embodiments of a shoe according to the invention will be described in detail with reference to the drawings. Note that the invention is not limited by the embodiments. In the following embodiments, the same or common portions are denoted by the same reference signs, and the description thereof will not be repeated.

In the following embodiments, a direction in which a heel center axis, which is a perpendicular line passing through the heel center of a sole in a plan view of a shoe, extends is referred to as a front-rear direction, and a direction orthogonal to the front-rear direction in a plan view of the shoe is referred to as a foot width direction.

In addition, of the front-rear direction, a direction directed from the end on the side where a portion of the sole supporting the rearfoot of a foot is positioned toward the end on the side where a portion of the sole supporting the forefoot of the foot is positioned is referred to as a front side, and of the front-rear direction, a direction directed from the end on the side where the portion of the sole supporting the forefoot of the foot is positioned toward the end on the side where the portion of the sole supporting the rearfoot of the foot is positioned is referred to as a rear side.

In addition, a median side of a foot in the anatomical position is referred to as a medial foot side, and the side opposite to the median side of the foot in the anatomical position is referred to as a lateral foot side. That is, the side closer to the median line in the anatomical position is referred to as the medial foot side, and the side farther from the median line in the anatomical position is referred to as the lateral foot side.

Furthermore, a height direction means a direction orthogonal to both the front-rear direction and the foot width direction unless otherwise specified.

First Embodiment

Figure 1:
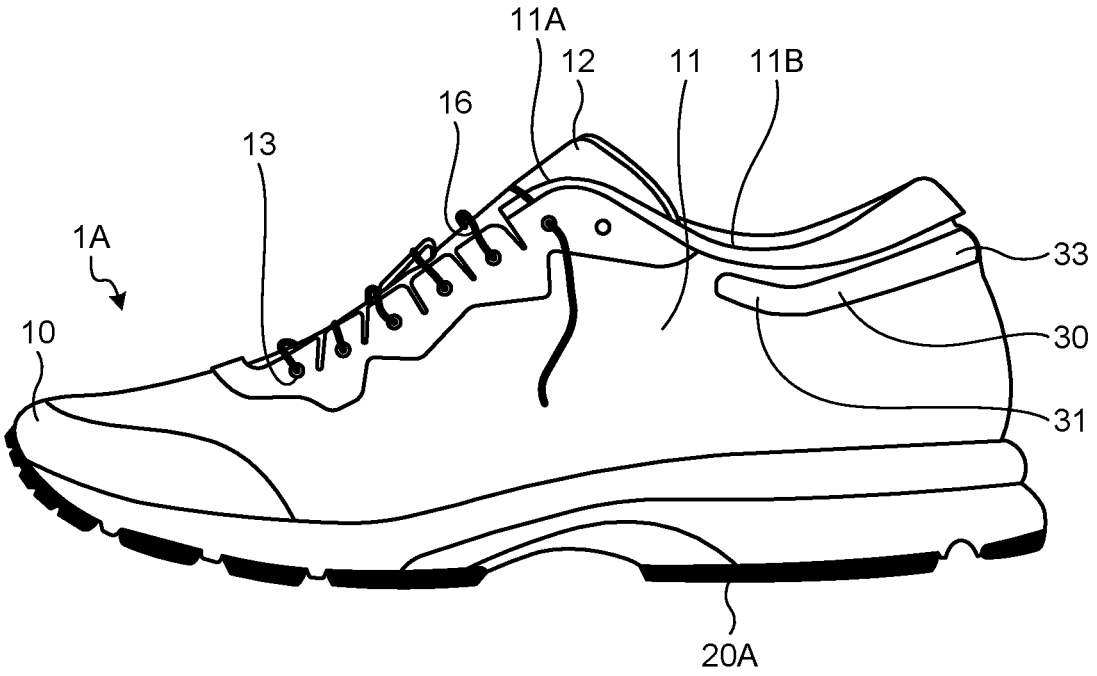
FIG. 1 is a side view of a shoe according to a first embodiment of the invention.

FIG. 1 is a side view of a shoe according to a first embodiment of the invention. A shoe 1A includes an upper 10 and a sole 20A. The upper 10 has a shape covering the entire part on the instep side of an inserted foot. The sole 20A is positioned below the upper 10 and covers the sole of the foot.

The upper 10 includes an upper body 11 and a shoe tongue 12. The shoe tongue 12 is fixed to the upper body 11. A shoelace 16 is detachably attached to the upper body 11.

The upper body 11 is provided with an upper opening 11A for exposing an upper part of the ankle and a part of the instep of the foot. The upper opening 11A of the upper body 11 has a peripheral edge provided with which a plurality of holes 13 is provided. The shoe tongue 12 is fixed to the upper body 11 by sewing, welding, bonding, or a combination thereof in such a manner as to cover a portion of the upper opening 11A provided in the upper body 11 for exposing a part of the instep of the foot. As the upper body 11 and the shoe tongue 12, woven fabric, knitted fabric, synthetic leather, or resin is used. Note that the material of the upper body 11 and the shoe tongue 12 is not limited to those exemplified.

The shoelace 16 is a string-like member and is inserted through the plurality of holes 13 of the upper body 11. The shoelace 16 inserted through the plurality of holes 13 pulls portions of the upper opening 11A of the upper body 11 corresponding to the instep of the foot toward each other in the foot width direction. By tightening the shoelace 16 while the foot is inserted in the upper body 11, it is possible to bring the upper body 11 into close contact with the foot.

Note that a hook-and-loop fastener may be used instead of the shoelace 16 to bring the upper body 11 into close contact with the foot. If a hook-and-loop fastener is used to bring the upper body 11 into close contact with the foot, the plurality of holes 13 is not formed in the upper body 11.

Of the upper opening 11A of the upper body 11, a portion on the rear side from the shoe tongue 12 is an opening 11B through which the wearer puts in and out the foot when the shoe 1A is put on or taken off. In general, the opening 11B is positioned at a part corresponding to 56.1% to 100% of the foot length from the tip on the instep side of the foot of a wearer having a standard body shape.

Figure 2:
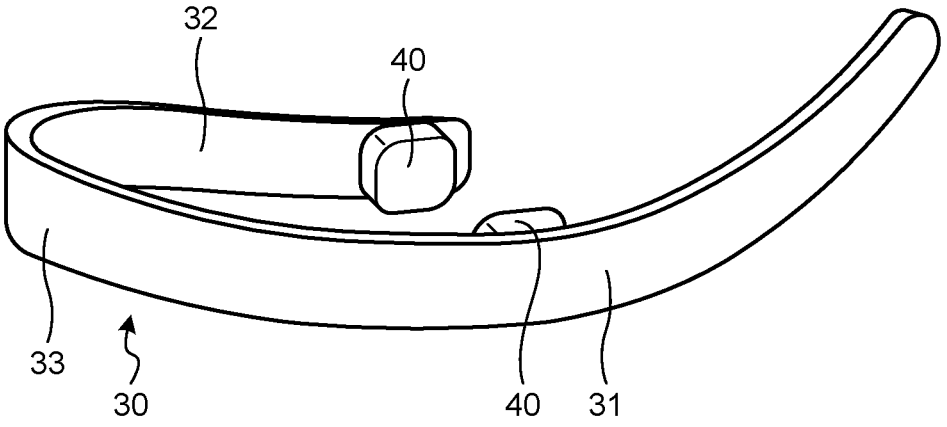
FIG. 2 is a perspective view of a correction member of the shoe according to the first embodiment.

The upper body 11 is provided with a correction member 30 surrounding the opening 11B. The correction member 30 is attached to the outside of the upper body 11. FIG. 2 is a perspective view of the correction member of the shoe according to the first embodiment. The correction member 30 includes an inner arm 31 fixed to the medial foot side of the opening 11B of the upper body 11, an outer arm 32 fixed to the lateral foot side of the opening 11B of the upper body 11, and a connection portion 33 connecting the inner arm 31 and the outer arm 32. The correction member 30 has a shape along the heel of the foot of a wearer having a standard body shape. Thus, when the shoe 1A is for men, the correction member 30 has a shape along the heel of the foot of a man having a standard body shape, and when the shoe 1A is for women, the correction member 30 has a shape along the heel of a woman having a standard body shape.

As illustrated in FIG. 1, the correction member 30 is attached to the upper body 11 from the rear in such a manner that the connection portion 33 is disposed on the rear side of the opening 11B. The correction member 30 is attached to the upper body 11 away from the sole 20A. The correction member 30 is attached to the upper body 11 at a distance of 5 mm or more from the sole 20A in the height direction.

The correction member 30 is made of an elastic material. Examples of the material of the correction member 30 include hard resin, such as a polyether block amide copolymer, and metal, such as titanium. However, the material of the correction member 30 is not limited to those exemplified.

The outer arm 32 of the correction member 30 attached to the upper body 11 extends below a portion of the upper body 11 corresponding to the lateral malleolus of the wearer. On the other hand, the inner arm 31 of the correction member 30 attached to the upper body 11 passes below a portion of the upper body 11 corresponding to the medial malleolus of the wearer and extends further forward and upward. For a man having a standard body shape, the medial malleolus is located 10 mm anterior and 14 mm superior to the lateral malleolus. On the other hand, for a woman having a standard body shape, the medial malleolus is located 8 mm anterior and 12 mm superior to the lateral malleolus. Thus, the end of the inner arm 31 may be at a forward and upward position of 3 mm or more with respect to the end of the outer arm 32.

The correction member 30 attached to the upper body 11 corrects the dimension of the opening 11B in the foot width direction to be equal to or smaller than the foot width dimension when the correction member 30 is not attached. That is, the opening width of the opening 11B in the foot width direction may be narrowed by the correction member 30 as compared with the case where the correction member 30 is not attached. In addition, the opening width of the opening 11B in the foot width direction may be the same by the correction member 30 as the width when the correction member 30 is not attached.

In addition, as illustrated in FIG. 2, in the correction member 30, cushion materials 40 are installed at a portion of the inner arm 31 disposed below the medial malleolus of the wearer at least facing the outer arm 32 and at a portion of the end of the outer arm 32 at least facing the inner arm 31. Examples of the material of the cushion materials 40 include an expanded foam material and soft resin. However, the material of the cushion materials 40 is not limited to those exemplified. The cushion materials 40 disperse a force that the inner arm 31 and the outer arm 32 squash the opening 11B in the foot width direction, and transmit the dispersed force to the foot of the wearer. That is, the area where the force generated by the inner arm 31 and the outer arm 32 is applied to the foot of the wearer is spread by installing the cushion materials 40, and the pressure applied to the foot of the wearer is reduced.

In the shoe 1A according to the first embodiment, the correction member 30 prevents the opening 11B from widening in the foot width direction when the foot of the wearer plantarflexes. Thus, a gap between the opening 11B and the foot of the wearer in the foot width direction is hardly generated when the foot of the wearer plantarflexes.

Figure 3:
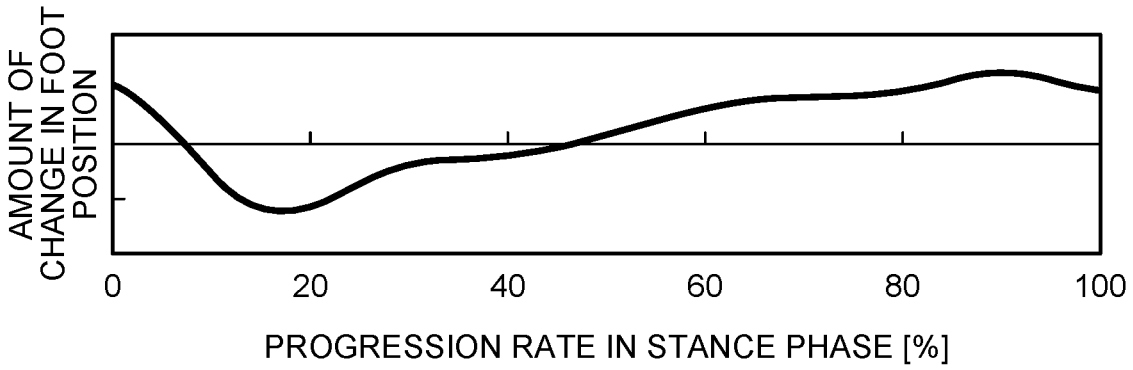
FIG. 3 is a diagram illustrating a change in the position of a foot in a vertical direction in a stance phase of a wearer of the shoe according to the first embodiment.

FIG. 3 is a diagram illustrating a change in the position of a foot in a vertical direction in a stance phase of a wearer of the shoe according to the first embodiment. The horizontal axis in FIG. 3 represents the degree of progression in the stance phase: the time at which the heel is on the ground is 0%, and the time at which the toe of the foot kicking backward is off the ground is 100%. The vertical axis in FIG. 3 represents the amount of the change using the position of the foot and the shoe 1A when the wearer stands and remains stationary as a reference: a state in which the foot of the wearer sinks into the shoe 1A is negative, and a state in which the foot of the wearer rises from the shoe 1A is positive. After the heel strike, as the foot of the wearer sinks into the shoe 1A, the position of the foot of the wearer changes in the negative direction, and as the foot of the wearer plantarflexes through the neutral state, the position of the foot of the wearer changes in the positive direction.

Figure 4:
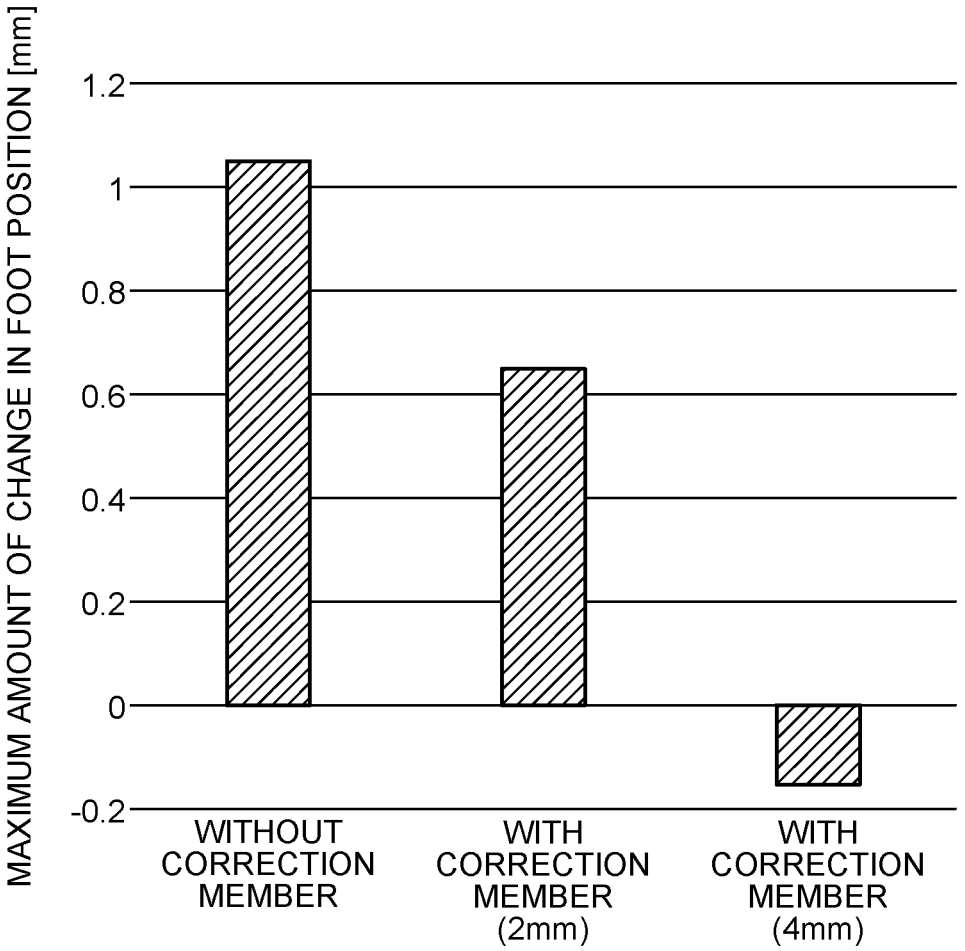
FIG. 4 is a diagram illustrating a maximum amount of the change in the position of the foot in the stance phase of the wearer of the shoe according to the first embodiment.

FIG. 4 is a diagram illustrating a maximum amount of the change in the position of the foot in the stance phase of the wearer of the shoe according to the first embodiment. FIG. 4 also illustrates, for comparison, a maximum amount of a change in the position of the foot in the stance phase of the wearer when a shoe not including the correction member 30 is worn. When a shoe not including the correction member 30 is worn, the maximum value of the amount of the change in the position of the foot of the wearer is plus 1.05 mm, whereas when the shoe 1A including the correction member 30 having a thickness of 2 mm is worn, the maximum value of the amount of the change in the position of the foot of the wearer is plus 0.65 mm. When the shoe 1A including the correction member 30 having a thickness of 4 mm is worn, the maximum value of the amount of the change in the position of the foot of the wearer is minus 0.18 mm. The maximum value of the amount of the change in the position of the foot of the wearer being a negative value means that the magnitude of the sinking of the foot of the wearer into the shoe 1A after the heel is on the ground is larger than the magnitude of the rising of the foot from the shoe 1A during the plantarflexion. As described above, when the thickness of the correction member 30 increases, the effect of reducing the change in the position of the foot of the wearer increases.

As compared with a shoe not including the correction member 30, the shoe 1A according to the first embodiment reduces the amount of the change in the position of the foot of the wearer and has a high fitting property to the foot of the wearer.

Since the correction member 30 is installed at a distance from the sole 20A in the height direction, the pronation of the foot of the wearer is not hindered at the time of the heel on the ground. Thus, the wearer is less likely to feel uncomfortable at the time of the heel on the ground during running.

When the wearer puts on and takes off the shoe 1A, the foot of the wearer pushes and widens the correction member 30, and the opening 11B is also widened in the foot width direction, and a special action is unnecessary when putting on and taking off the shoe 1A.

In the shoe 1A according to the first embodiment, since the attachment position of the correction member 30 can be visually checked, the positioning of the correction member 30 is easy. That is, the correction member 30 of the shoe 1A according to the first embodiment is easily attached to an appropriate position.

Furthermore, in the shoe 1A according to the first embodiment, since the correction member 30 is disposed on the outer side of the upper body 11, it is possible to be easily visually checked whether the correction member 30 is installed. Thus, it is easy to prevent the occurrence of a defect such as forgetting to attach the correction member 30 when the shoe 1A is manufactured. In addition, since the correction member 30 is visible, its appearance is differentiated from a shoe not including the correction member 30, and it is thus possible for a person who intends to purchase the shoe 1A including the correction member 30 to easily select the shoe 1A from a plurality of shoes.

Figure 5:
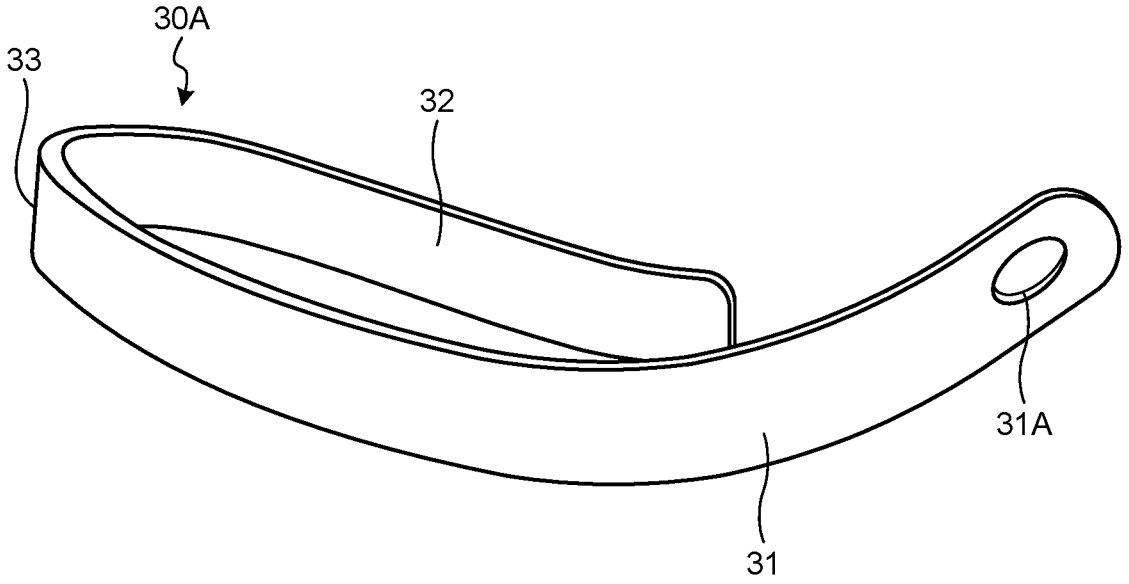
FIG. 5 is a diagram illustrating a first modification of the correction member of the shoe according to the first embodiment.

FIG. 5 is a diagram illustrating a first modification of the correction member of the shoe according to the first embodiment. A correction member 30A according to the first modification is attached to the upper body 11 instead of the correction member 30 to constitute the shoe 1A. In the correction member 30A according to the first modification, a hole 31A through which the shoelace 16 passes is formed at the end of the inner arm 31. Note that the cushion materials 40 are not illustrated in FIG. 5. The correction member 30A according to the first modification is attached to the upper body 11 in such a manner that the hole 31A overlaps the rearmost hole 13 of the plurality of holes 13 on the medial foot side.

In the correction member 30A according to the first modification, the end of the inner arm 31 is biased to the center in the foot width direction by tightening the shoelace 16. By biasing the end of the inner arm 31 to the center in the foot width direction, the entire inner arm 31 is biased to the center in the foot width direction. Thus, in the shoe 1A using the correction member 30A, a force to squash the opening 11B in the foot width direction is generated by tightening the shoelace 16. By using the correction member 30A according to the first modification for the shoe 1A, it is possible to further enhance the fitting property to the foot of the wearer.

Figure 6:
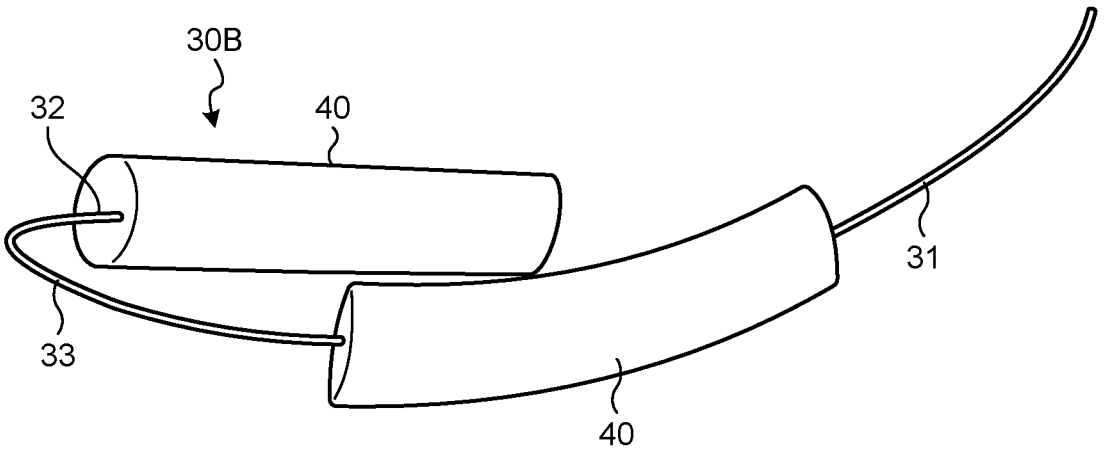
FIG. 6 is a diagram illustrating a second modification of the correction member of the shoe according to the first embodiment.

FIG. 6 is a diagram illustrating a second modification of the correction member of the shoe according to the first embodiment. A correction member 30B according to the second modification is attached to the upper body 11 instead of the correction member 30 to constitute the shoe 1A. The correction member 30B according to the second modification has a rod shape over the entire inner arm 31, the outer arm 32, and the connection portion 33. The cushion materials 40 each have a tubular shape, and the inner arm 31 and the outer arm 32 penetrate the cushion materials 40. In the correction member 30B according to the second modification, since the inner arm 31 and the outer arm 32 penetrate the cushion materials 40, the cushion materials 40 do not easily fall off from the inner arm 31 and the outer arm 32. Thus, the shoe 1A using the correction member 30B according to the second modification is enhanced in durability as compared with the shoe 1A using the correction member 30.

In a shoe not including the correction member 30, since only the portion corresponding to the instep of the foot of the wearer is tightened by a tightening member such as a shoelace or a hook-and-loop fastener, tightening at the sides of the ankle of the wearer is likely to be insufficient, and a gap between the opening and the foot of the wearer in the foot width direction is easily generated. On the other hand, in the shoe 1A according to the first embodiment, since the opening 11B is tightened from the sides of the ankle of the wearer by the correction member 30, 30A, or 30B, a gap between the opening 11B and the foot of the wearer in the foot width direction is hardly generated. That is, the shoe 1A according to the first embodiment has a high effect of preventing the foot from being displaced inside the shoe 1A and getting a shoe sore and preventing the fitting property to the foot of the wearer from being lowered as compared with a shoe not including the correction member 30.

Second Embodiment

Figure 7:
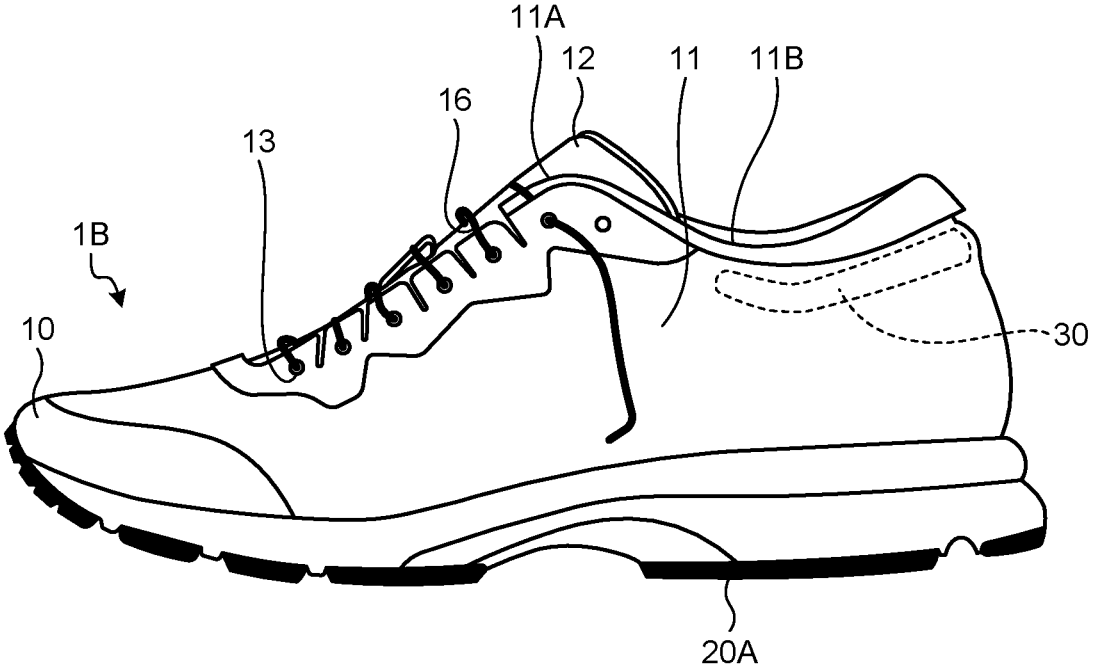
FIG. 7 is a side view of a shoe according to a second embodiment of the invention.

FIG. 7 is a side view of a shoe according to a second embodiment of the invention. A shoe 1B according to the second embodiment is different from the shoe 1A according to the first embodiment in that a correction member 30 is incorporated in an upper body 11. The description common to the shoe 1A according to the first embodiment will be omitted.

Figure 8:
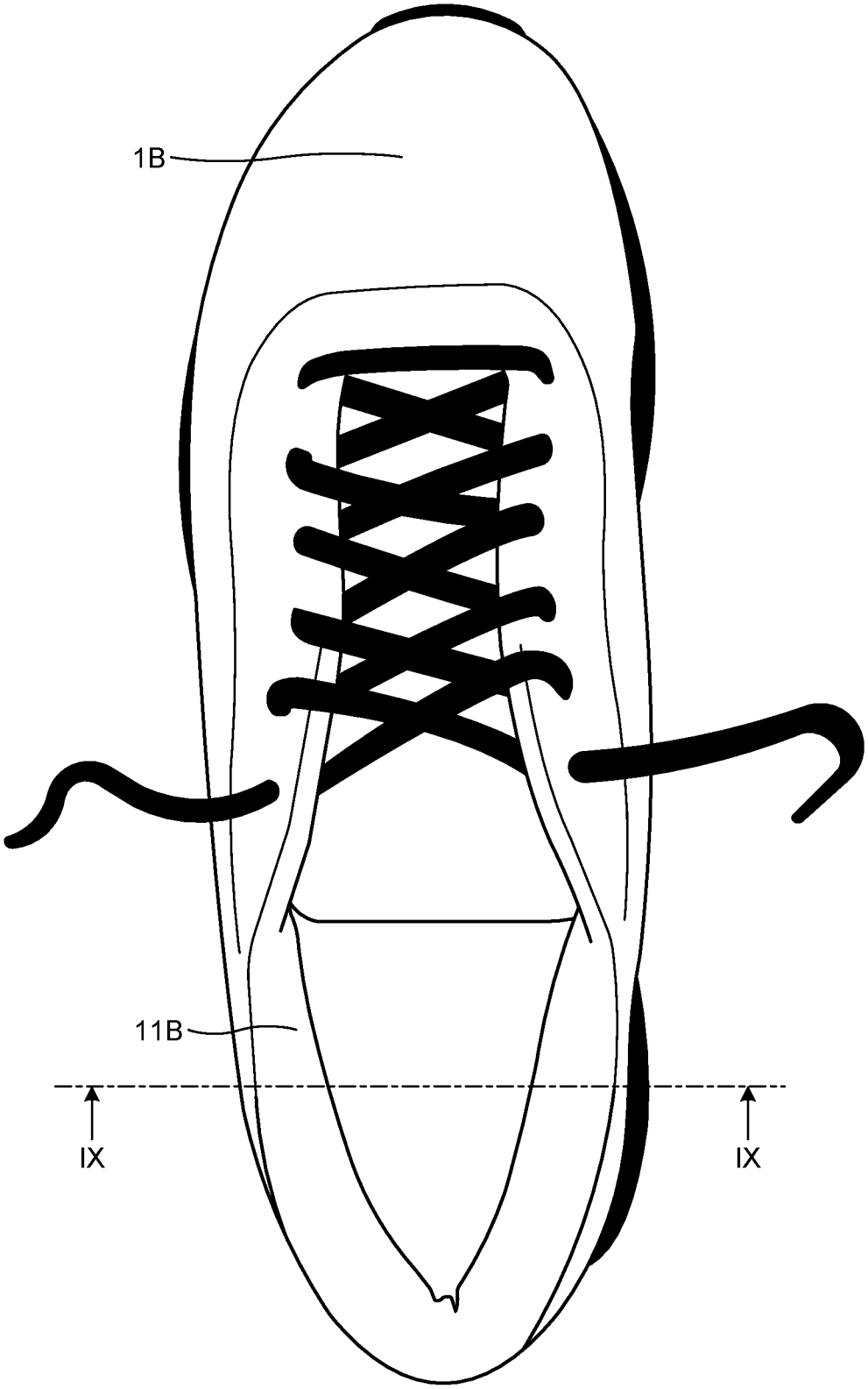
FIG. 8 is a top view of the shoe according to the second embodiment.
Figure 9:
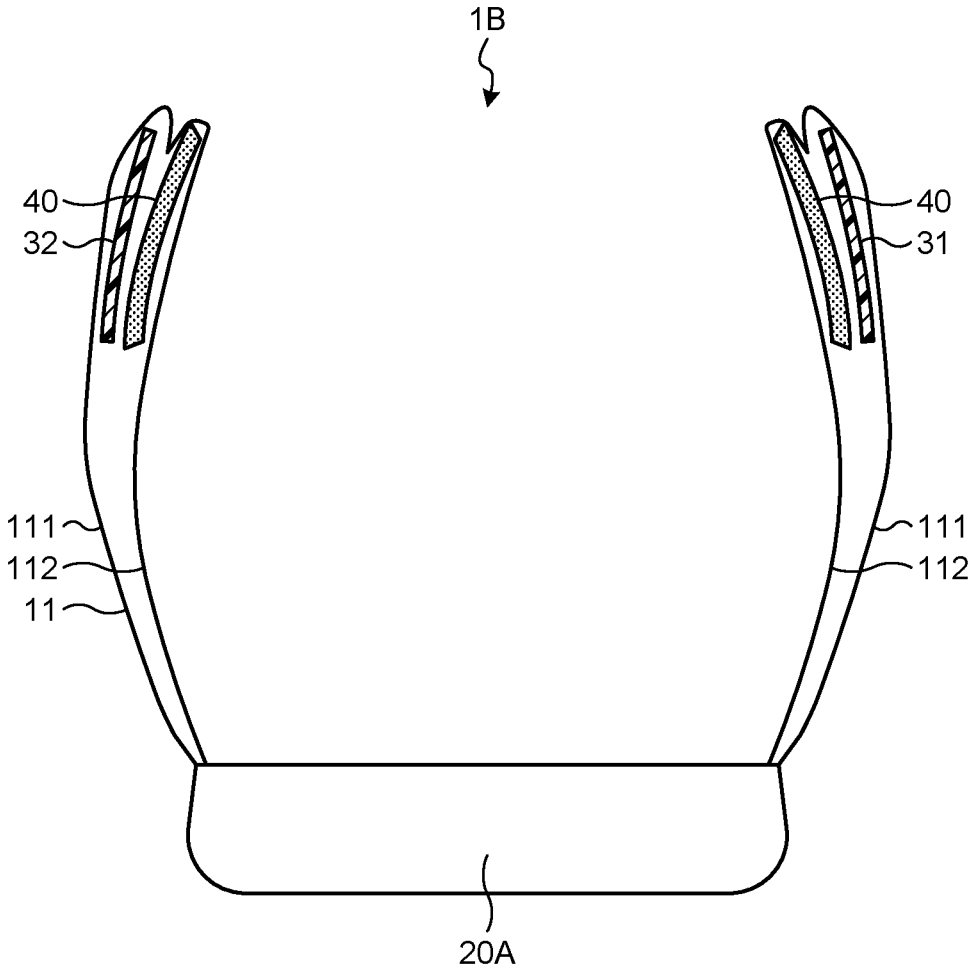
FIG. 9 is a cross-sectional view of an opening of the shoe according to the second embodiment.

FIG. 8 is a top view of the shoe according to the second embodiment. FIG. 9 is a cross-sectional view of an opening of the shoe according to the second embodiment. The cross section illustrated in FIG. 9 illustrates a cross section of the shoe 1B taken along the line IX-IX in FIG. 8. In the correction member 30 used for the shoe 1B according to the second embodiment, all of an inner arm 31, an outer arm 32, and a connection portion 33 are inserted between an outer material 111 and a lining 112 of the upper body 11. The correction member 30 is bonded and fixed to the outer material 111 and the lining 112. Cushion materials 40 are disposed between the inner arm 31 and the lining 112 and between the outer arm 32 and the lining 112. The cushion materials 40 are bonded and fixed to the lining 112.

In the shoe 1B according to the second embodiment, since the correction member 30 is installed inside the upper body 11, the correction member 30 does not easily fall off while the shoe 1B is worn. In addition, since the correction member 30 is bonded to both the outer material 111 and the lining 112 of the upper body 11, the correction member can be more firmly fixed as compared with the case of being attached to the outside of the upper body 11. Thus, the shoe 1B according to the second embodiment has higher durability than that of the shoe 1A according to the first embodiment. In the shoe 1B according to the second embodiment, since the correction member 30 is covered with the outer material 111 of the upper body 11, there are few restrictions on the design of the shoe 1B. For example, in the shoe 1B according to the second embodiment, decorative parts can be installed on the surface of the outer material 111 of the portion where the correction member 30 is disposed to enhance the aesthetic appearance.

Third Embodiment

Figure 10:
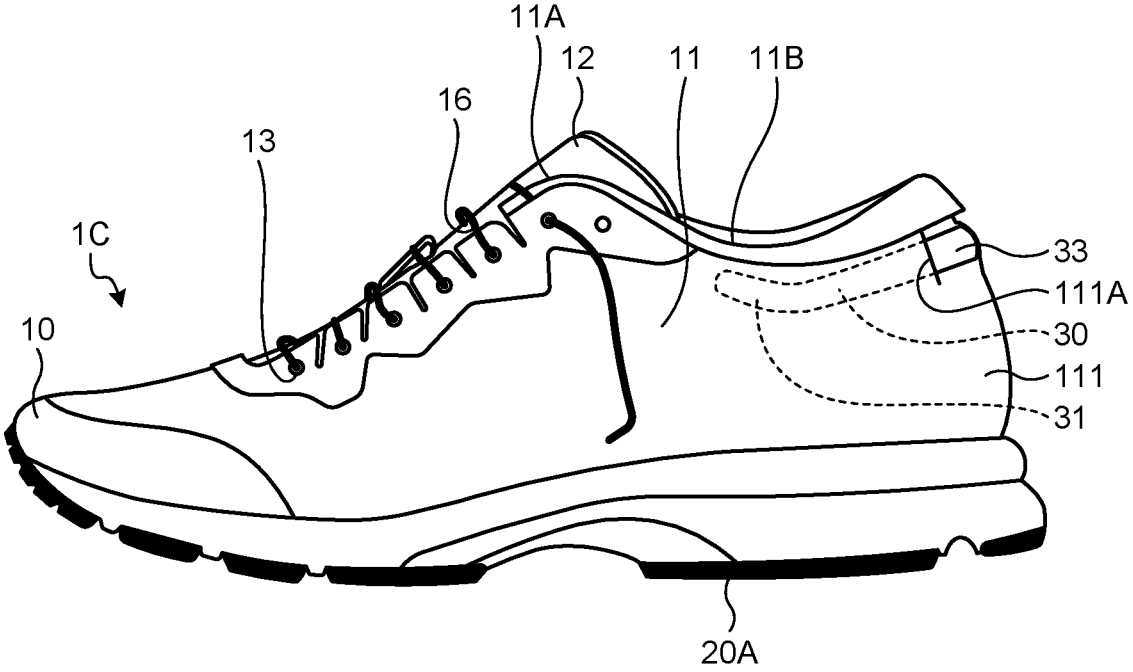
FIG. 10 is a side view of a shoe according to a third embodiment of the invention.

FIG. 10 is a side view of a shoe according to a third embodiment of the invention. A shoe 1C according to the third embodiment is different from the shoe 1A according to the first embodiment in that only a connection portion 33 of a correction member 30 is disposed outside an upper body 11 and that an inner arm 31 and an outer arm 32 are disposed inside the upper body 11. The description common to the shoe 1A according to the first embodiment will be omitted.

In the upper body 11, holes 111A are formed in an oblique rear-side portion of an outer material 111 of the heel, and the inner arm 31 and the outer arm 32 are inserted into the upper body 11 through the holes 111A. The cross section of the shoe 1C at the portion where the inner arm 31 and the outer arm 32 are disposed is similar to the cross section of the shoe 1B according to the second embodiment illustrated in FIG. 9. That is, the inner arm 31 and the outer arm 32 are disposed between the outer material 111 and a lining 112.

In the shoe 1C according to the third embodiment, since the connection portion 33 of the correction member 30 is exposed to the outer side of the upper body 11, it is possible to be easily visually checked whether the correction member 30 is installed. Thus, it is easy to prevent the occurrence of a defect such as forgetting to attach the correction member 30 when the shoe 1C is manufactured. In addition, since the connection portion 33 of the correction member 30 is visible, its appearance is differentiated from a shoe not including the correction member 30, and it is thus possible for a person who intends to purchase the shoe 1C including the correction member 30 to easily select the shoe 1C from a plurality of shoes.

Fourth Embodiment

Figure 11:
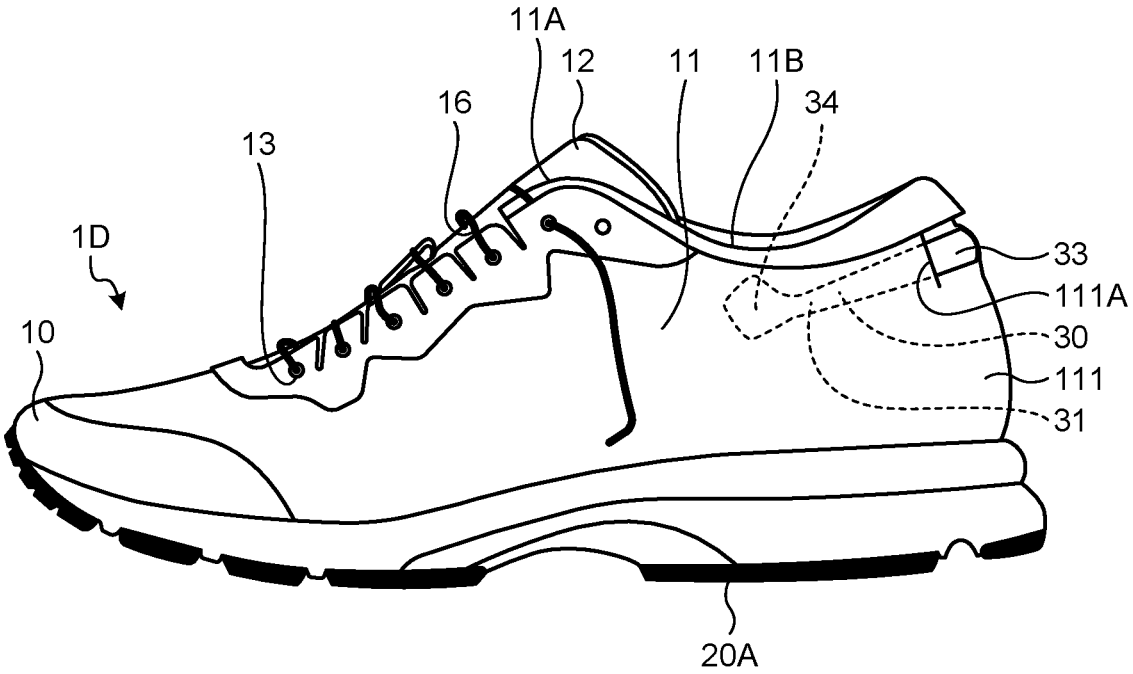
FIG. 11 is a side view of a shoe according to a fourth embodiment of the invention.

FIG. 11 is a side view of a shoe according to a fourth embodiment of the invention. A shoe 1D according to the fourth embodiment is different from the shoe 1C according to the third embodiment in that retaining portions 34 are formed at the ends of an inner arm 31 and an outer arm 32. The description common to the shoe 1C according to the third embodiment will be omitted. By forming the retaining portions 34 larger than holes 111A of an outer material 111, the inner arm 31 and the outer arm 32 cannot be pulled out unless the holes 111A of the outer material 111 are expanded to pass the retaining portions 34 therethrough, and a correction member 30 does not easily fall off from an upper body 11.

Fifth Embodiment

Figure 12:
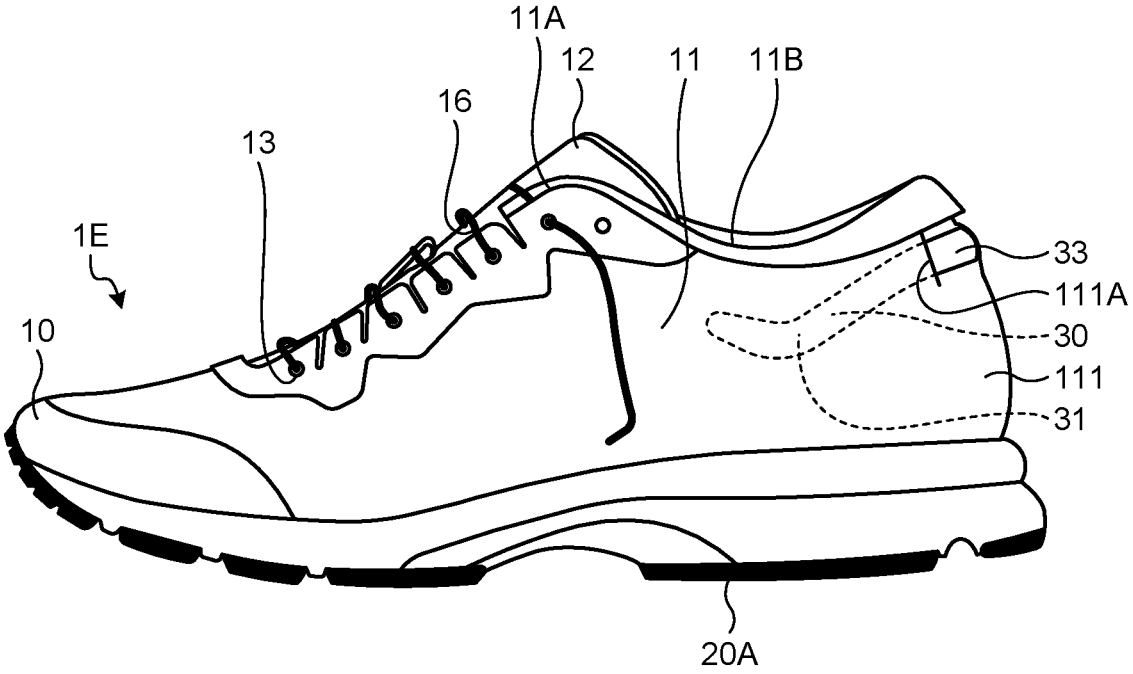
FIG. 12 is a side view of a shoe according to a fifth embodiment of the invention.

FIG. 12 is a side view of a shoe according to a fifth embodiment of the invention. A shoe 1E according to the fifth embodiment is different from the shoe 1A according to the first embodiment in that the ends of an inner arm 31 and an outer arm 32 are positioned lower than a connection portion 33. The description common to the shoe 1A according to the first embodiment will be omitted. In the shoe 1E according to the fifth embodiment, the inner arm 31 and the outer arm 32 are installed at positions separated downward from an opening 11B. Thus, even if a correction member 30 is attached to an upper body 11, the opening width of the opening 11B in the foot width direction hardly changes as compared with the case where the correction member 30 is not attached.

When it is desired to strongly hold a foot of a wearer from the foot width direction with the inner arm 31 and the outer arm 32 of the correction member 30, the opening width of the opening 11B in the foot width direction can be too narrow if the correction member 30 is installed close to the opening 11B. In the shoe 1E according to the fifth embodiment, the ends of the inner arm 31 and the outer arm 32 are positioned lower than the connection portion 33, and the inner arm 31 and the outer arm 32 are installed at positions separated downward from the opening 11B. Thus, the wearer easily inserts the foot into the opening 11B even if the correction member 30 having a strong elastic force is installed.

The configurations described in the above embodiments merely show examples of the invention and can be combined with another known technique, and a part of each configuration can be omitted or changed without departing from the gist of the invention.

The shoe according to the invention has an effect that a gap between an opening and a foot of a wearer in a foot width direction is hardly generated when the foot of the wearer plantarflexes.

What is claimed is:

1. A shoe comprising:

a sole provided with a ground contact surface;

an upper provided with an opening into which a foot of a wearer is inserted, the upper being attached to the sole and covering the foot of the wearer; and a correction member including an inner arm fixed to a medial foot side of the opening of the upper, an outer arm fixed to a lateral foot side of the opening of the upper, and a connection portion connecting the inner arm and the outer arm, the correction member being attached to the upper away from the sole in such a manner that the connection portion is disposed on a rear side of the opening, wherein the outer arm extends below a portion of the upper corresponding to a lateral malleolus of the wearer, and the inner arm passes below a portion of the upper corresponding to a medial malleolus of the wearer and further extends forward and upward so that an end of the inner arm is fixed to the upper at a forward and upward position, the forward and upward position being 3 mm or more forward and upward than an end of the outer arm, and a length of the inner arm is longer than the outer arm.

2. The shoe according to claim 1, wherein the correction member includes cushion materials installed at a portion of the inner arm disposed below a medial malleolus of the wearer at least facing the outer arm and at a portion of the end of the outer arm at least facing the inner arm.

3. The shoe according to claim 1, wherein an opening width of the opening in a foot width direction is narrowed by the correction member as compared with a case where the correction member is not attached.

4. The shoe according to claim 1, wherein the correction member is attached to an outside of the upper.

* * * * *